US005899027A

United States Patent [19]

St. Louis

[11] Patent Number: 5,899,027

[45] Date of Patent: May 4, 1999

[54] CONTAMINANT SHIELD

[75] Inventor: Daniel M. St. Louis, West Bloomfield, Mich.

[73] Assignee: Haden, Inc., Auburn Hills, Mich.

[21] Appl. No.: 08/901,400

[22] Filed: Jul. 28, 1997

[51] Int. Cl.[6] ..... E04B 1/12

[52] U.S. Cl. ..... 52/63; 52/222; 52/273; 52/202

[58] Field of Search ..... 52/63, 202, 203, 52/222, 273, 81.3; 135/101, 97; 156/325, 306.6; 160/327, 354, 368.1, 369, 383

[56] References Cited

U.S. PATENT DOCUMENTS

| | | | |
|---|---|---|---|
| 4,769,692 | 9/1988 | Pohl et al. . | |
| 4,860,778 | 8/1989 | Pohl . | |
| 4,926,605 | 5/1990 | Milliken et al. | 52/63 |
| 5,044,131 | 9/1991 | Fisher | 52/63 |
| 5,181,354 | 1/1993 | Krueger et al. | 52/79.1 |
| 5,209,029 | 5/1993 | Foerst | 52/63 |
| 5,224,306 | 7/1993 | Cramer | 52/63 |
| 5,383,312 | 1/1995 | St. Louis et al. | 52/63 |
| 5,647,176 | 7/1997 | Milliken et al. | 52/63 |

OTHER PUBLICATIONS

Tri–Mark Metal Corp., Tri–Tunnel® publication (1 page)
Standard C–Wall™ Struction publication, (1 page).

*Primary Examiner*—Christopher Kent
*Assistant Examiner*—Yvonne Horton-Richardson
*Attorney, Agent, or Firm*—Niro, Scavone, Haller & Niro

[57] ABSTRACT

An improved contaminant shield and method for making the shield, including one or more panels constructed of interconnected frame members, such as extruded aluminum, having longitudinal recesses and consisting of substantially closed sections in closed sections in cross-sections. Thin flexible sheeting is inserted within the frame members, and fastening members are used to frictionally engage the recesses and capture the sheeting in seli-tensioned position.

8 Claims, 3 Drawing Sheets

10
20
20
30
40

CONTAMINANT SHIELD

BACKGROUND OF THE INVENTION

The entire disclosure of commonly assigned U.S. Pat. No. 5,383,312 is hereby incorporated by reference herein.

The present invention relates in general to shields used to prevent air-borne particles from contaminating the environment within the shield. More particularly, the invention relates to clean environment enclosures typically employed in paint operations in manufacturing plants.

In manufacturing facilities where products are painted, it is necessary that the environment immediately surrounding the paint operation be as free as possible from dust, dirt and other air-borne contaminants in order to provide the best application of paint to the product.

Various forms of enclosures have been used to prevent air-borne contaminants from interfering with the paint application process. Such contaminant shields or "clean environment enclosures" are typically provided with positive airflow into the enclosure to prevent dust and dirt from entering the open ends of the enclosure. They are built of rigid side and top panels with opposed ends, with an attached flexible sheet(s) covering the periphery.

Two examples of prior art contaminant shields are disclosed in U.S. Pat. Nos. 4,769,962 and 4,860,778. These enclosures are relatively expensive to manufacture and require lengthy installation times. For example, with each of these prior art shields flexible sheets are attached to individual panels in a relatively complicated manner, using multiple connectors and/or a "tongue-in-groove" connection system, with clamps or other supports also being employed.

The shield disclosed in U.S. Pat. No. 5,383,312 is an improvement over these prior art shields, and provides a controlled environment enclosure which can be more easily and inexpensively constructed, quickly altered in structure, adapted for different applications and easily repaired. Further improvements in contaminant shields are possible, however.

Most contaminant shields used for automotive painting utilize Unistrut (steel) frame members and custom plastic Unistrut caps to retain the plastic film. The Unistrut frame members consist of open section (C-channel) lengths which are only available in steel, and which do not provide adequate strength if they are constructed of lighter weight materials such as aluminum. in another design, a frame is constructed of tubular steel, a steel rod is welded to the front face of the frame around its perimeter, and a plastic clip is used to retain the plastic to the steel frame.

In still another design, a plastic extrusion is inserted into an open section C-channel, the film is inserted over the extrusion, and a plastic bead is then inserted over the film to couple with the extrusion and seal the film. This design is overly complicated and also provides less strength since it employs an open section frame assembly.

In a further design disclosed in U.S. Pat. No. 5,181,354, a main frame of tube steel has a steel rod welded to its surface. A rounded retainer or clip is snapped over the rod, securing a shrink film in place. One disadvantage with this design is that the convex shape of the retainer creates a dust ledge. A second disadvantage is that the film tends to pool with water adjacent the raised retainer surface.

In every known design, the frames are constructed of steel. However, steel frames are heavy and unwieldy. It is also difficult to fasten modular steel panels, which are typically shipped to a job site for installation, using conventional means such as self-drilling ("Tek") screws.

An object, therefore, of the present invention is to provide an contaminant shield which can be economically constructed from inexpensive materials.

Another object of the present invention is to provide a lightweight contaminant shield which can be quickly and easily constructed in the field.

A further object of the present invention is to provide a contaminant shield which can be assembled into a variety of shapes without providing a dust ledge, and which can be easily altered or repaired.

SUMMARY OF THE INVENTION

These and other objects are provided by the present invention, which preserves the advantages of known controlled environment or contaminant shield enclosures, and which overcomes the disadvantages of and provides new advantages for such enclosures.

The contaminant shield enclosure of the present invention provides a clean environment ideally suited for paint operations in manufacturing plants. The contaminant shield includes a plurality of modular panels, each panel being constructed from one or more substantially rigid frame members having recesses formed within and running along their lengths. The recesses preferably run continuously or substantially continuously along the lengths of the frame members, so that an air-tight seal can be provided. The frame members, which may be made from extruded aluminum or fiber-reinforced plastic, for example, preferably consist of substantially closed sections in cross-section. Thin flexible sheeting, made preferably of a material which does not shrink substantially when heat, is provided, and includes portions insertable within the recesses of the frame members. Fastening members are also provided, and are shaped and sized for direct frictional engagement with the recesses to capture the inserted portions of the thin flexible sheeting. In a preferred embodiment, the fastening members, when inserted within the recesses, are substantially coplanar with the flexible sheeting on one side of the frame members, so that no dust ledges are formed. The frame members and the fastening members maintain the flexible sheeting in self-tensioned position on one side of the frame members. The frame members serve both as the structural support for the shield and as a primary component of the fastening mechanism for the sheeting.

In one preferred embodiment of the contaminant shield, first and second sets of fastening members are associated with a first panel. At least first and second sets of adjacent and parallel recesses running along the frame member lengths of the first panel are also provided. The sheeting of the first panel is engaged by the first sets of recesses and the first set of fastening members, while the sheeting of at least one adjacent panel is engaged by the second set of recesses and the second set of fastening members. The frame members can be formed into a plurality of individual modular panels, with the flexible sheeting being cut into a plurality of sheets, each correspondingly-sized to fit an individual panel. Adjacent panels can be interconnected using single-sided adhesive tape.

A method for constructing a contaminant shield also forms a part of the present invention. A plurality of substantially rigid frame members are joined to form one or more panels. Each frame member has longitudinal recesses running substantially continuously along its length. Portions of a thin flexible sheeting are inserted within the longitudinal recesses of the frame members. The flexible sheeting is captured in self-tensioned position within the recesses by inserting fastening members into the recesses and in direct frictional engagement with the recesses and the sheeting to maintain the sheeting in tensioned position on one side of the frame members. Again, the frame members serve both as the structural support for the shield and as a primary component of the fastening system for the sheeting. Using this process, various panels can be constructed and interconnected to form a contaminant enclosure with at least a top, two sides, and two opposing ends. A positive airflow can be introduced through the enclosure to maintain a dust-free environment.

Using the contaminant shield of the present invention, torn or worn sheeting is easily replaced. The appropriate fastening members are removed. The desired sheeting is then removed, and new sheeting is inserted into the recesses on the appropriate frame members. The new sheeting is again captured and self-tensioned by once again engaging the appropriate fastening members to the frame members.

The contaminant shield of the present invention provides unique advantages regarding the construction or repair of such shields or barriers, since it minimizes installation and service time, and reduces the manufacturing cost. For example, the individual panels, and then the frame, can be constructed on site. The advantage of mass producing identical or nearly identical frames is realized, as well.

BRIEF DESCRIPTION OF THE DRAWINGS

The various features, advantages and other uses of the present invention will become more apparent by reference to the following drawings and detailed description in which.

DETAILED DESCRIPTION OF THE PREFERRED EMBODIMENTS

Figure 1:
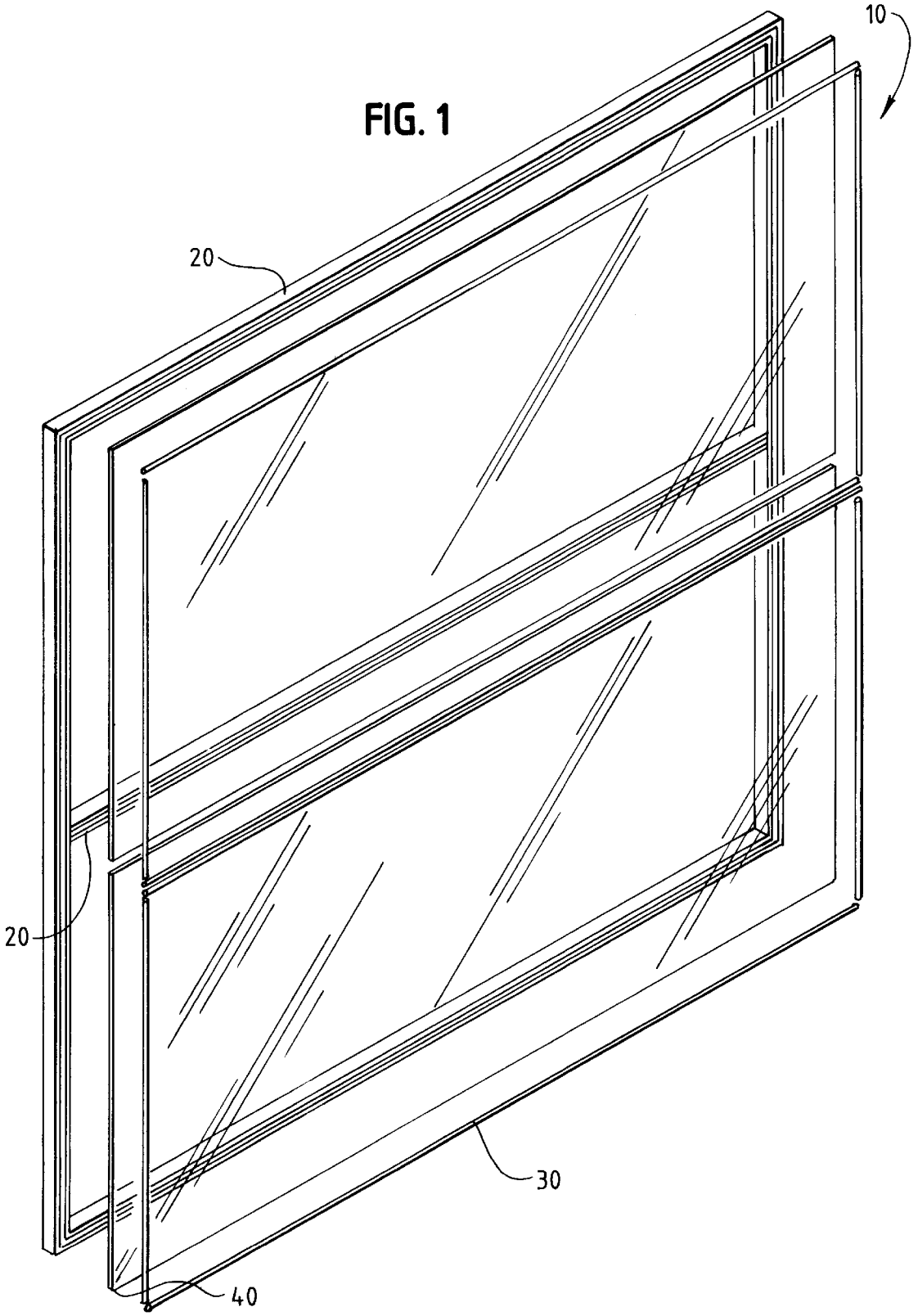
FIG. 1 is a perspective, schematic view of individual panels used to form one embodiment of the contaminant shield of the present invention, shown prior to assembly.

The contaminant shield of the present invention forms an enclosure (not shown) which typically consists of two sides and a top, and provides a contaminant-free environment ideally suited for use in paint operations in a manufacturing plant. Referring to FIG. 1, the enclosure is formed from modular panels designated generally as 10. Panel 10 is made of interconnected structural frame members 20, which may extend horizontally and vertically. Of course, frame members 20 may be formed so as to extend at any angle. Also, panels 10 may each consist of only one or a number of frame members 20, and may be formed in any shape, as further described below. In one preferred embodiment (not shown), frame members 20 are spaced to form vertically extending sides, a roof and opposed open ends, to allow positive airflow through the enclosure.

Frame members 20 may be coupled by any expedient method. For example, frame members 20 can be provided which are hollow, and which are sized to slide within one another. Alternatively, frame members 20 can be fastened to each other by welding, or by using Tek screws or other fasteners. For example, a single frame member can be formed into a single panel using welding techniques. Adjacent frame members 20 or adjacent panels 10 may be secured by a clip or any other known attaching mechanism, such as glue, tape or other fasteners; however, these means of attachment are not necessary for use of the present invention.

Figure 2:
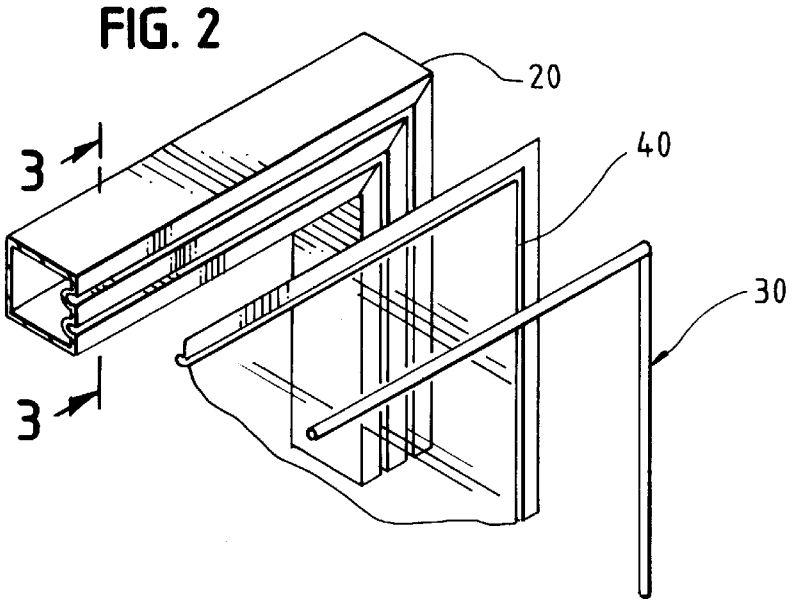
FIG. 2 is a perspective view of a portion of the panel components in a preferred embodiment of the present invention.

To construct one embodiment of the contaminant shield of the present invention, individual panels or modules 10, consisting of frame members 20, are first formed. The frame members preferably consist of a lightweight material, such as extruded aluminum tubing or fiber-reinforced plastic. Referring to a preferred embodiment shown in FIGS. 2 and 3, extruded aluminum frame members 20 consist of closed-end or substantially closed-end sections, for added strength, and can be square (e.g. 2 inches on a side), rectangular or circular in cross-section, for example. Frame 20 also includes film-attachment areas which form a primary component of the film attachment mechanism. In a preferred embodiment shown in FIGS. 2 and 3, frame members 20 include two adjacent, parallel grooves or recesses G1 and G2 built into one of the extruded sides. The grooves are designed to capture sheeting material by pressing a length of beading material, such as common plastic tubing 30, into a groove and over a sheeting edge. Preferably, the recesses run substantially continuously along the lengths of frame members 20, to provide a continuous seal and to eliminate any entry points for particulates. Thus, extruded frame members 20 act as both the structural member for the modular frame as well as a primary component of the fastening system.

Flexible sheeting 40 (such as 6 mil. polyethylene, or an EVA copolymer) can be first sized to fit the panel. Alternatively, a continuous sheet can be used, and cut during or after attachment.

In a preferred embodiment, two adjacent grooves G1, G2 are used. Inner groove G2 captures sheeting associated with its panel, and outer groove G1 may be used to capture sheeting associated with adjacent panels. Alternatively, only one or more than two grooves can be used, and the grooves can vary in size, length and thickness to suit the need and specific application.

Figure 3:
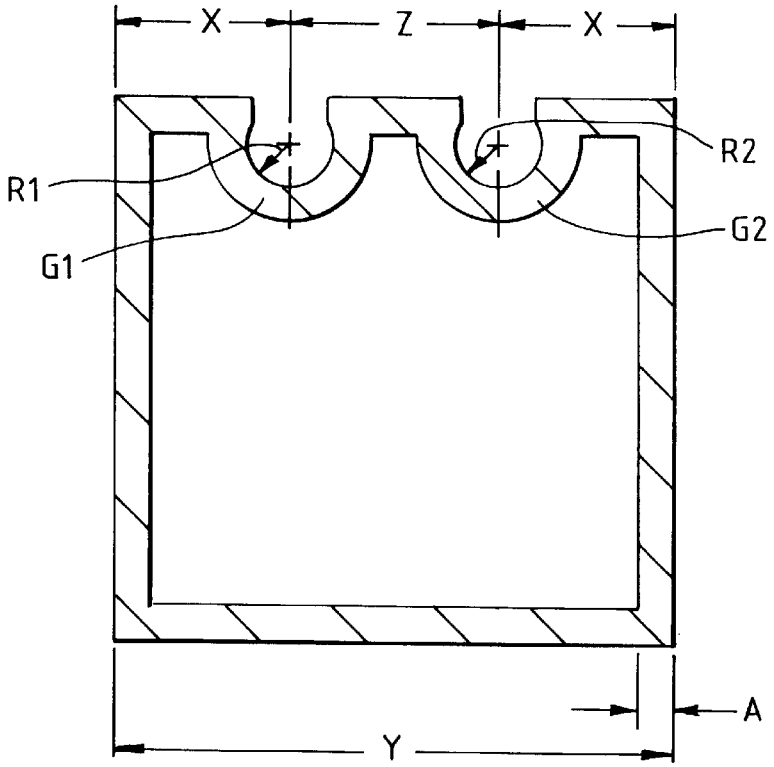
FIG. 3 is a view taken along section line 3—3 of FIG. 2 of a preferred embodiment of the present invention.
Figure 4:
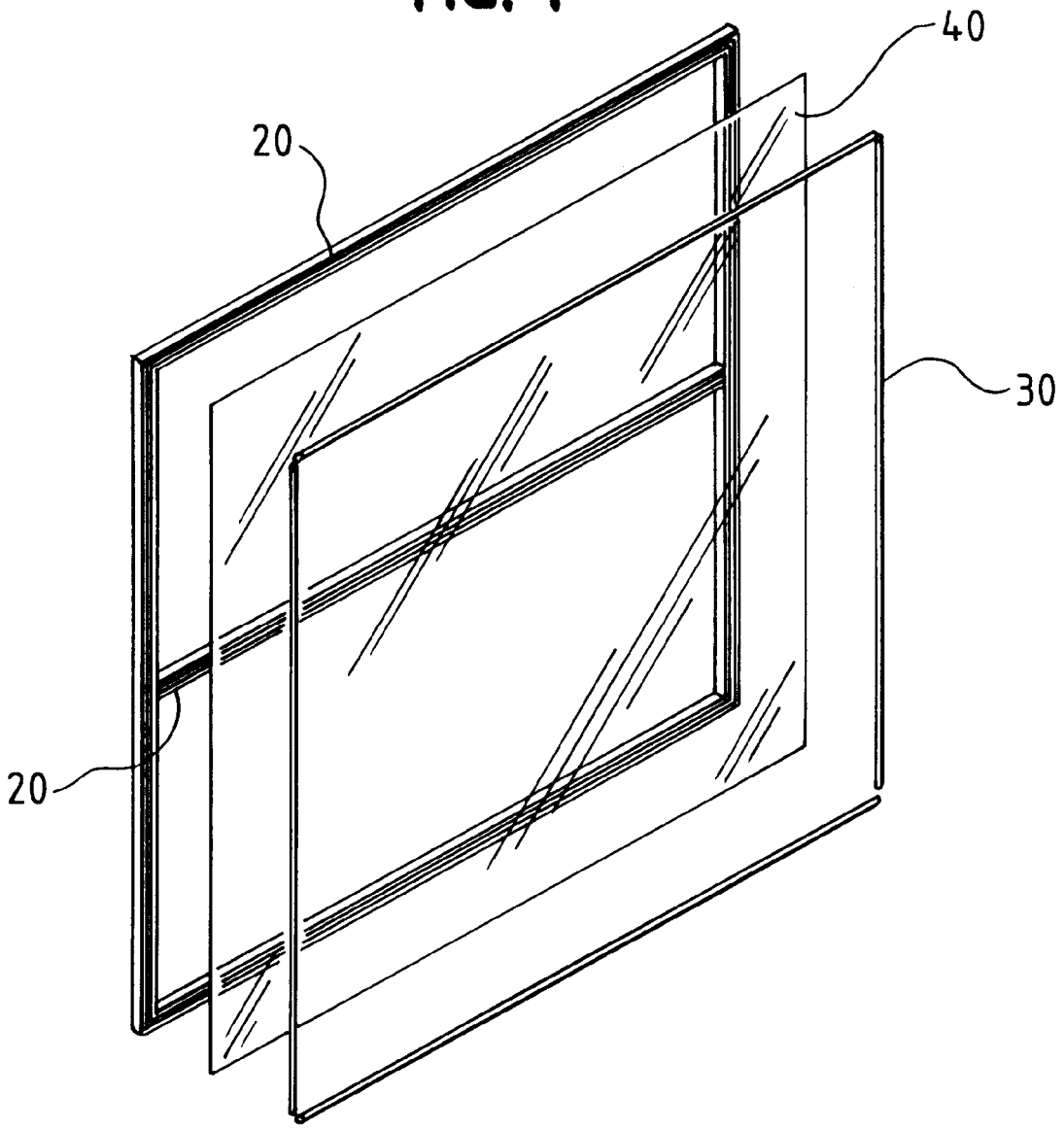
FIG. 4 is a perspective, schematic view similar to FIG. 1 of an alternative embodiment of the invention.

In one preferred embodiment, referring to FIG. 3, the distance "x" between an edge of the frame member to the centerline of the curved radius associated with grooves G1 and G2 is 0.625 inches; radii R1 and R2 are each 0.156 inches;, the centerline-to-centerline distance "z" between adjacent grooves G1, G2 is 0.750 inches; and the length "y" of each square frame member is 2.000 inches. Dimension A is 0.125 inches.

Any suitable closed cross-sectional geometrical shape for the frame members can be provided, depending upon the particular application. Preferably, however, the groove (3) or recess(es) are symmetrically located relative to the cross-section of the frame member, since this facilities frame member connection.

The sheets can be sized to allow overlap between adjacent modules, and the adjacent modules can be joined by any suitable means, such as Tek screws or single-sided adhesive tape, to seal the joints between the modules, and to enhance the shear strength of the sheets spanning the frame. Once the modules are interconnected and the frame is formed, the application of heat will allow sheets of an appropriate material such as polyethylene (e.g., visquine) to shrink, giving the sheeting a residual tensile stress and providing a relatively smooth surface covering the frame. However, heat tensioning is typically not necessary, as explained below.

The present invention allows for several alternative constructions. The whole frame can be first constructed out of panels, and then either a large single flexible sheet, or smaller individual sheets, can be used to cover the frame in the manner described above. Alternatively, after the frame members are joined to form each module, appropriately sized individual sheets can be affixed to each module in the manner described above, and then the individuals modules can be interconnected (using, for example, Tek screws and/or single-sided adhesive tape) to form the shield.

One advantage of the present invention is that sheeting materials other than polyethylene can be used, such as polyester (e.g., mylar), vinyls, various cloths or fabrics, or other materials which do not shrink substantially when subjected to heat. That is because using the present invention the sheeting can be easily pre-tensioned during attachment to frame 20, alleviating the need for the application of heat to the sheeting. Automatic film tensioning or "self-tensioning" is permitted by the invention since, as the plastic tubing 30 is pressed into a groove on aluminum frame member 20, any excess film can automatically be pulled with it.

Panels 110 of the present invention can be constructed quickly and inexpensively. While the frame can be constructed of any relatively strong, relatively light weight material, such as reinforced plastic, fiberglass or aluminum, extruded aluminum is preferred due to its malleability, its light weight, and its strength and rigidity. Frame members constructed of extruded aluminum can be easily handled (since slender and light weight) and provide sufficient strength, even if sheet heat tensioning is employed with corresponding stresses on the frame members.

Individual frame members can be connected to form any geometrical shape, so that square, rectangular or triangular panels or modules can be utilized. As mentioned above, frame members can be connected to each other by any means known to those of skill in the art, including various metal fasteners, such as bolts, thumb screws or Tek screws, or by the use of socket joints (i.e., a tube-within-a-tube fit). it will now be apparent that a number of advantages, in addition to those already discussed, flow from the use of this invention. Joining different panels, especially using Tek screws, is much easier and faster due to the light weight aluminum, rather than steel, construction. The use of aluminum also allows the extrusion of custom shapes for the frame members in an economical manner, and permits their purchase directly from a mill for less than the cost of commercially available square aluminum tubing. Further, because the finished panel is flush or nearly so on the film side, dust ledges are eliminated. Additionally, the attachment method of the present invention facilitates the replacement of the flexible sheeting. The extruded aluminum frame members are also aesthetically appealing and require no further finishing, such as painting or galvanizing.

Other alternatives within the scope of the invention will be apparent, as well. For example, one, two or more adjacent grooves can be used with the frame members, as needed. With the two-groove embodiment shown in FIGS. 2–3, for example, large panels can be subdivided, for either covering or film replacement purposes, into smaller sections using a minimum of structure. The invention can also be used to create enclosures which are built up first in situ and then covered, rather than modular panels. in some case this may be more economical than shipping modular frames to the job site.

Repairs to the contaminant shield of the present invention are easily accomplished in the field. If the sheeting of a particular panel requires replacement, plastic tubing 30 is simply removed, the sheeting is replaced, and the beading material is repositioned.

The present invention enables the construction and use of a contaminant shield which is less costly to manufacture and easier to repair than prior art contaminant shields. Further, all of the materials required to manufacture the present invention are relatively inexpensive, and readily available in large quantities.

Of course, it should be understood that various changes and modifications to the preferred embodiments described herein will be apparent to those skilled in the art. For example, tubing 30 can be designed with attachment grooves to allow the film to be fastened to or within the tubing itself. Also, grooves on more than one face of the tubing or of different cross-sections can be used. Further, it is foreseeable that sufficiently strong and light weight materials other than aluminum may be used to provide similar attendant advantages. Such modifications and changes can be made to the illustrated embodiments without departing from the spirit and scope of the present invention, and without diminishing the attendant advantages. It is, therefore, intended that such changes and modifications be covered by the following claims.

I claim:

1. A contaminant shield, comprising:

a plurality of modular panels, each panel being constructed from one or more substantially rigid frame members, each member having at least first and second adjacent and parallel recesses formed within and running along its length, the frame members consisting of substantially closed sections in cross-section;

thin flexible sheeting having portions insertable within the at least first and second recesses of the frame members;

fastening members shaped and sized for direct frictional engagement with the recesses to capture the inserted portions of the thin flexible sheeting;

wherein the recesses and the fastening members maintain the flexible sheeting in self-tensioned position on one side of the frame members, the frame members thereby serving both as the structural support for the shield and as a primary component of the fastening mechanism for the sheeting; and wherein there are first and second sets of fastening members associated with a first panel, and at least first and second adjacent and parallel recesses running along the frame members of the first panel, and the sheeting of the first panel is cooperatively engaged by the first recesses and the first set of fastening members, while the sheeting of at least one adjacent panel is cooperatively engaged by the second recesses and the second set of fastening members.

2. The contaminant shield of claim 1, wherein the frame members comprise extruded aluminum.

3. The contaminant shield of claim 1, wherein the frame members comprise fiber-reinforced plastic.

4. The contaminant shield of claim 1, wherein the at least first and second recesses run substantially continuously along the lengths of the frame members.

5. The contaminant shield of claim 1, wherein the fastening members, when inserted within the at least first and second recesses, are substantially coplanar with the flexible sheeting and the one side of the frame members.

6. The contaminant shield of claim 1, wherein the flexible sheeting comprises a material which does not substantially shrink when heated.

7. The contaminant shield of claim 1, wherein the frame members form a plurality of individual modular panels, and the flexible sheeting includes a plurality of sheets each correspondingly sized to span a panel.

8. The contaminant shield of claim 1, wherein the at least first and second recesses are located symmetrically relative to the cross-section of each frame member.

* * * * *